United States Patent [19]

Heaps, Jr. et al.

[11] Patent Number: 4,850,506

[45] Date of Patent: Jul. 25, 1989

[54] CONTAINER FOR FLUENT MATERIAL

[75] Inventors: Harry D. Heaps, Jr., Villanova; Charles E. Boy, Exton, both of Pa.

[73] Assignee: Connelly Containers, Inc., Bala-Cynwyd, Pa.

[21] Appl. No.: 160,005

[22] Filed: Feb. 24, 1988

Related U.S. Application Data

[62] Division of Ser. No. 944,502, Dec. 17, 1986, Pat. No. 4,771,917.

[51] Int. Cl.[4] ..... B65D 5/60

[52] U.S. Cl. ..... 220/403; 220/441; 220/415; 229/41 C; 229/109

[58] Field of Search ..... 220/441, 415, 403, 408; 229/109, 41 C, 110

[56] References Cited

U.S. PATENT DOCUMENTS

| | | | |
|---|---|---|---|
| 901,695 | 10/1908 | Davis | 229/109 |
| 2,410,148 | 10/1946 | Buhrmaster . | |
| 2,673,024 | 3/1954 | Kuss | 229/110 |
| 2,794,588 | 6/1957 | George et al. . | |
| 3,148,444 | 9/1964 | Stark | 229/41 C |
| 3,204,849 | 9/1965 | Vinney . | |
| 3,744,702 | 7/1973 | Ellison | 220/415 |
| 3,873,017 | 3/1975 | Blatt . | |
| 4,019,635 | 4/1977 | Boots . | |
| 4,166,567 | 9/1979 | Beach, Jr. et al. . | |
| 4,205,775 | 6/1980 | Swan . | |
| 4,296,860 | 10/1981 | Hsu . | |
| 4,421,253 | 8/1977 | Croley . | |
| 4,441,649 | 4/1984 | Nedervold . | |
| 4,585,143 | 4/1986 | Fremow et al. . | |
| 4,693,413 | 9/1987 | McFalland et al. | 220/441 |
| 4,729,505 | 3/1988 | Remarks et al. | 229/41 C |
| 4,742,951 | 5/1988 | Kelly et al. | 220/408 |

*Primary Examiner*—Willis Little

*Attorney, Agent, or Firm*—Mason, Fenwick & Lawrence

[57] ABSTRACT

A container is provided for large quantities of fluent material and comprises laminated walls, each of which is made of multi-wall corrugated board. A bag of flexible material is provided within the container and has a first fitting which extends into an opening through a wall of the container near the bottom; a flap covers the opening and conceals the fitting being held in position by a severable strap. The container has bottom-forming flaps extending from the intermediate one of three layers forming the container to form a bottom for the container. The discharge fitting is secured to a flap which extends from a bottom plate extending through an opening in the flap and having flanges on either side of the flap, there being a tab partially cut from the flap with a free edge adjacent the opening, so that the fitting may be inserted through the opening formed by the tab and then slid into position in the small opening with the flanges on either side of the flap and being held in position by restoration of the tab to its normal position. An assembly is provided which includes a top plate, a bottom plate and a bag, with the bag secured to the top and bottom plates, preferably by the locking of a fitting to each of the plates. There is also provided a flattened container having steel bands on it in the flattened condition.

10 Claims, 5 Drawing Sheets

20
21
22
23
24
25
30
31
35
40
41
42
43
44
46
47
50
51e
52
53
61e
62
63e
64
70
71g
72
73
74g
75g

FIG-6
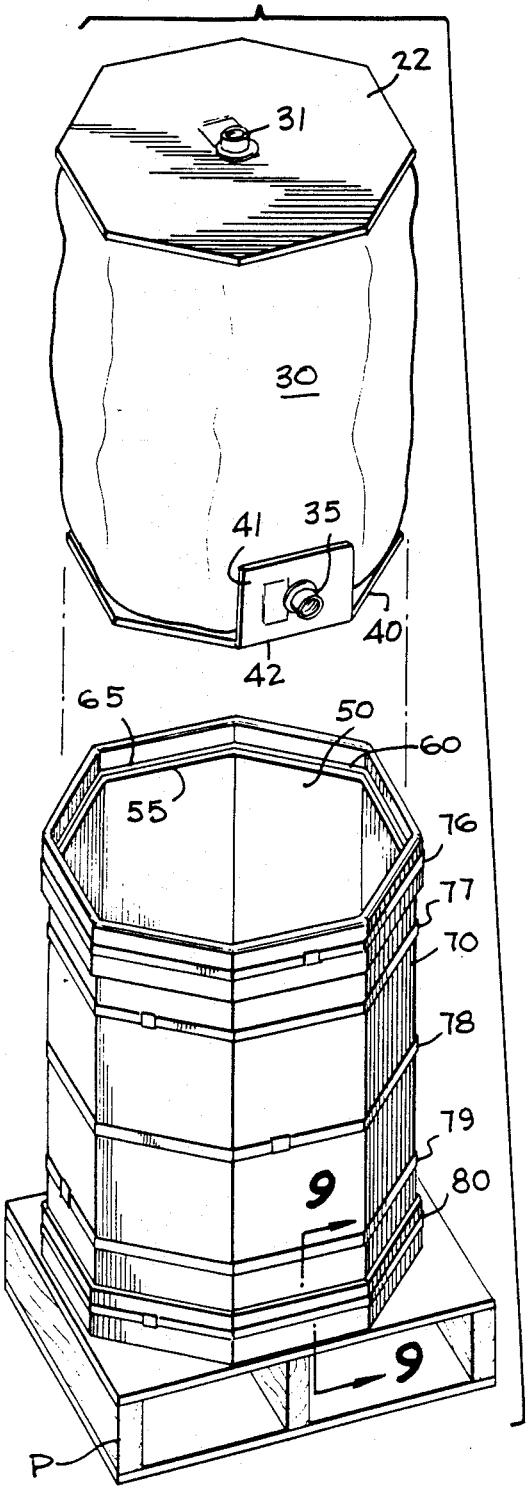
FIG-7
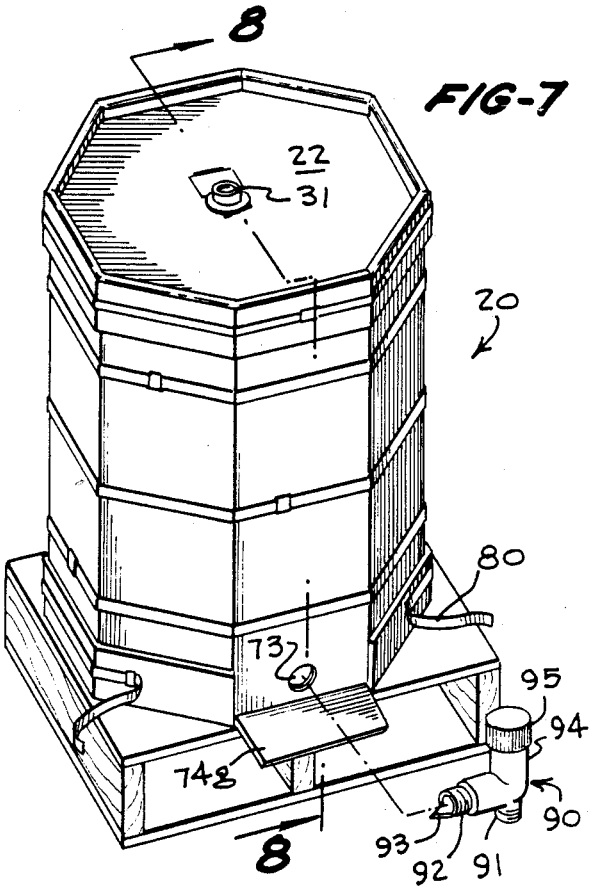
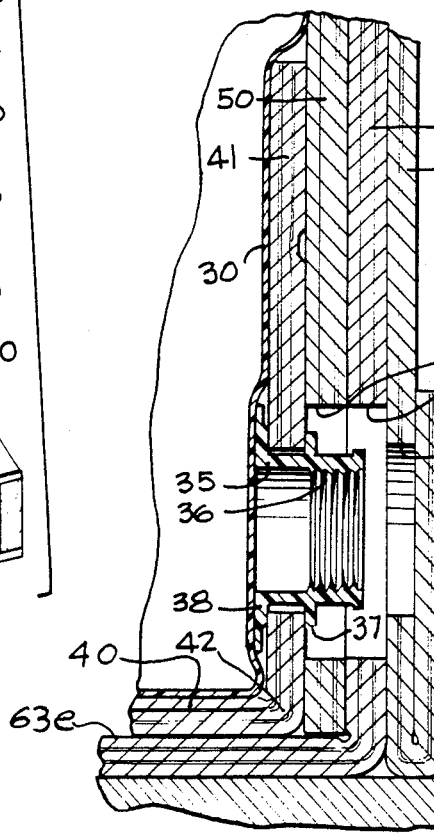
FIG-9

FIG-8
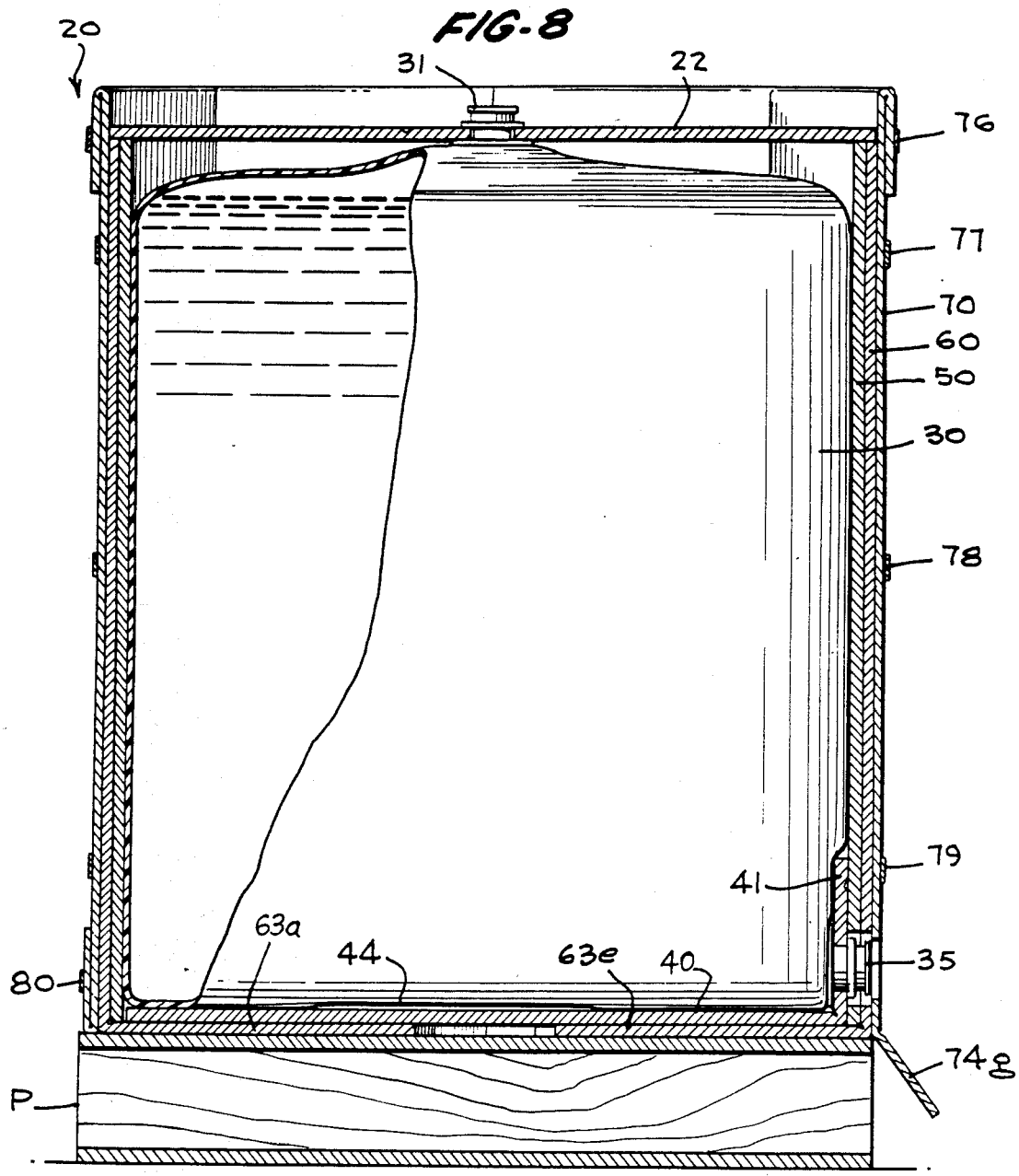
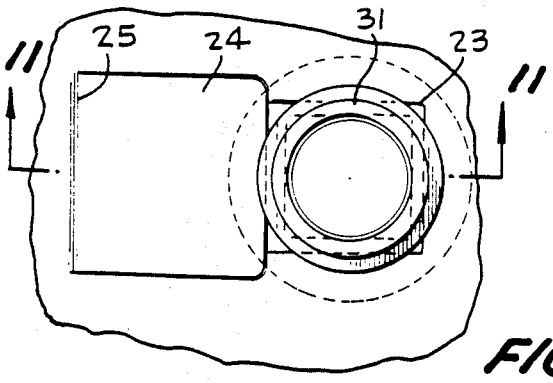
FIG-10
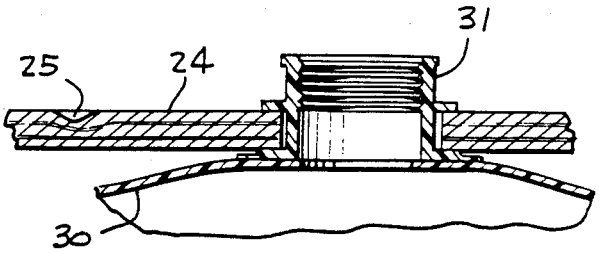
FIG-11

CONTAINER FOR FLUENT MATERIAL

This application is a division of application Ser. No. 944,502, filed Dec. 17, 1986 now U.S. Pat. No. 4,771,917.

BACKGROUND OF THE INVENTION

The present invention relates to a container for fluent material.

Many containers have been provided to ship fluent material, such as liquid and paste materials. Typically, it is required that large quantities of such materials be shipped and various constructions of strong containers have been provided in order to sustain the weight of the materials shipped.

Croley, U.S. Pat. No. 4,421,253, discloses that containers for the shipment of as much as three hundred gallons or more of liquid or semi-liquid materials were previously made of metal or reinforced plastic. These were costly to produce, store and ship and had to be returned at high freight rate and cleaned, thus resulting in an expensive construction and operation. This patent reports that fibreboard containers having a bag were less expensive, and were known to be supplied in knocked-down form. The construction of this patent required the placement of tension straps around the container at the place where the container was filled, had an extending spout structure and the container, when shipped by the producer in knocked-down form, had multiple parts to be assembled to provide the completed container.

Fremow, et al., U.S. Pat. No. 4,585,143, provides a liquid container with an internal bag and includes tension straps for securing the container to a pallet, the construction providing an extending discharge spout near the bottom of the bag.

Boots, U.S. Pat. No. 4,019,635, provides a pallet-mounted, eight-sided container with internal plastic bag and comprises a sleeve nailed to the pallet and extending upwardly around the bottom of the bag, thereby requiring substantial expense in the erection of the container.

Beach, Jr. et al., U.S. Pat. No. 4,166,567, is an example of a container having multilaminated walls of polygonal form with an internal bag. Still another example of a container formed of multi-wall, corrugated board of polygonal form and mounted on a pallet and having an internal bag is Hsu et al., U.S. Pat. No. 4,296,860. This patent provides a specialized bottom construction for the container and its association with the pallet.

Still other constructions of interest include Buhrmaster, U.S. Pat. No. 2,410,148, and George et al., U.S. Pat. No. 2,794,588 which disclose containers with multiple thickness near their tops and bottoms to provide extra strength; Vinney, U.S. Pat. No. 3,204,849, providing a multi-walled tube-type container shipped in flattened form; Blatt, U.S. Pat. No. 3,873,017, providing a polygonal container shipped in flattened form; and Nederveld, U.S. Pat. No. 4,441,649, providing a polygonal container of triple-wall, corrugated board which may be placed on a pallet.

SUMMARY OF THE INVENTION

A container for shipment of large volumes and weights of semi-liquid or liquid materials is provided, the container having a multi-panel, multi-wall construction. The panels are formed so as to provide a polygonal container, preferably of eight sides, there being an outer shell and an inner liner laminated of double thickness of triple-wall board. The intermediate layer is provided with flaps of tapezoidal shape which extend horizontally to form the container bottom. A bag is provided having standard fluid-conducting fittings at the top and at the side near the bottom, the bag being of polygonal, specifically, octagonal construction. The top or filling fitting is secured in a top plate which has an opening and a tab partially cut from the top plate and movable on a foldline to expose a second and larger opening adjacent and communicating with the first opening. The fitting may be passed through the opening provided by the tab and then slid laterally into the small opening where it is held when the tab is restored to normal position in the plane of the top plate. Preferably, the fitting has a pair of axially spaced flanges which may engage on either side of the top plate when slid into the small opening adjacent the tab. A bottom plate is provided of octagonal shape like the top plate, but of slightly smaller size, the bottom plate having a flap extending from it; the bottom or discharge fitting is secured in an opening in the flap on the bottom plate in the same manner as the filling fitting is secured to the top plate. The container is made of corrugated board, including the top and bottom plates, and the corrugations run transversely of the foldline between the bottom plate and the flap.

The liner has an opening in a panel at the bottom, and the shell has an opening in alignment with it in a panel near the bottom. The shell has double-over cuffs at the top and bottom, formed by folded-over flaps. In the assembled condition, a flap of the cuff overlies the opening through the shell and the discharge fitting extends only into the opening in the liner, being in alignment with the opening in the shell.

A container kit is provided to be assembled, the kit comprising the shell in flattened form with tension bands encircling it. The liner is packed separately. Another major component is an assemblage, including the bag and the top and bottom plate with the fittings secured in place in the top plate and the flap of the bottom plate. Assembly is accomplished by erecting the shell as a polygonal tube with the tension bands in place, inserting the liner with the panels with the openings therein in alignment, the flaps being folded inwardly to provide a bottom with the erecting of the container taking place, preferably on a pallet. The assemblage of the bag and top and bottom plates takes place with the flap in alignment with the panels having the openings, the bottom plate passing downwardly through the liner and the top plate coming to rest on the ledge of the liner. The bag is then filled through the filling fitting in the top plate, and a closure cap is put in place. The filled container is then shipped, and it is only necessary at the point of use to sever the lower tension band, move the flap covering the opening, and then place a faucet with a cutter and valve in the discharge fitting.

Among the objects of the present invention are to provide a shipping container for large quantities of liquid which is of great strength and of economical construction which may be shipped as a kit and assembled with minimal effort and tools by relatively unskilled labor to provide such a container which will have fittings in place and be protected during shipment, which is also easily assembled as a kit at the point of manufacture, and which may be readily placed in use for discharge by the ultimate user of the material shipped in the container.

Other objects, and many of the attendant advantages of the present invention, will be understood from the following specification and appended claims and the attached drawing.

BRIEF DESCRIPTION OF THE DRAWINGS

FIG. 6 is an exploded perspective view illustrating the assemblage of the container.

FIG. 7 is a perspective view illustrating the container ready for dispensing.

FIG. 8 is a cross-sectional view taken on the line 8—8 of FIG. 7.

FIG. 9 is an enlarged cross-sectional view of a part of the structure of FIG. 8.

FIG. 10 is plan view of a part of the container and a fitting in accordance with the present invention.

FIG. 11 is cross-sectional view taken on the line 11—11 of FIG. 10.

DESCRIPTION OF THE PREFERRED EMBODIMENT

Figure 1:
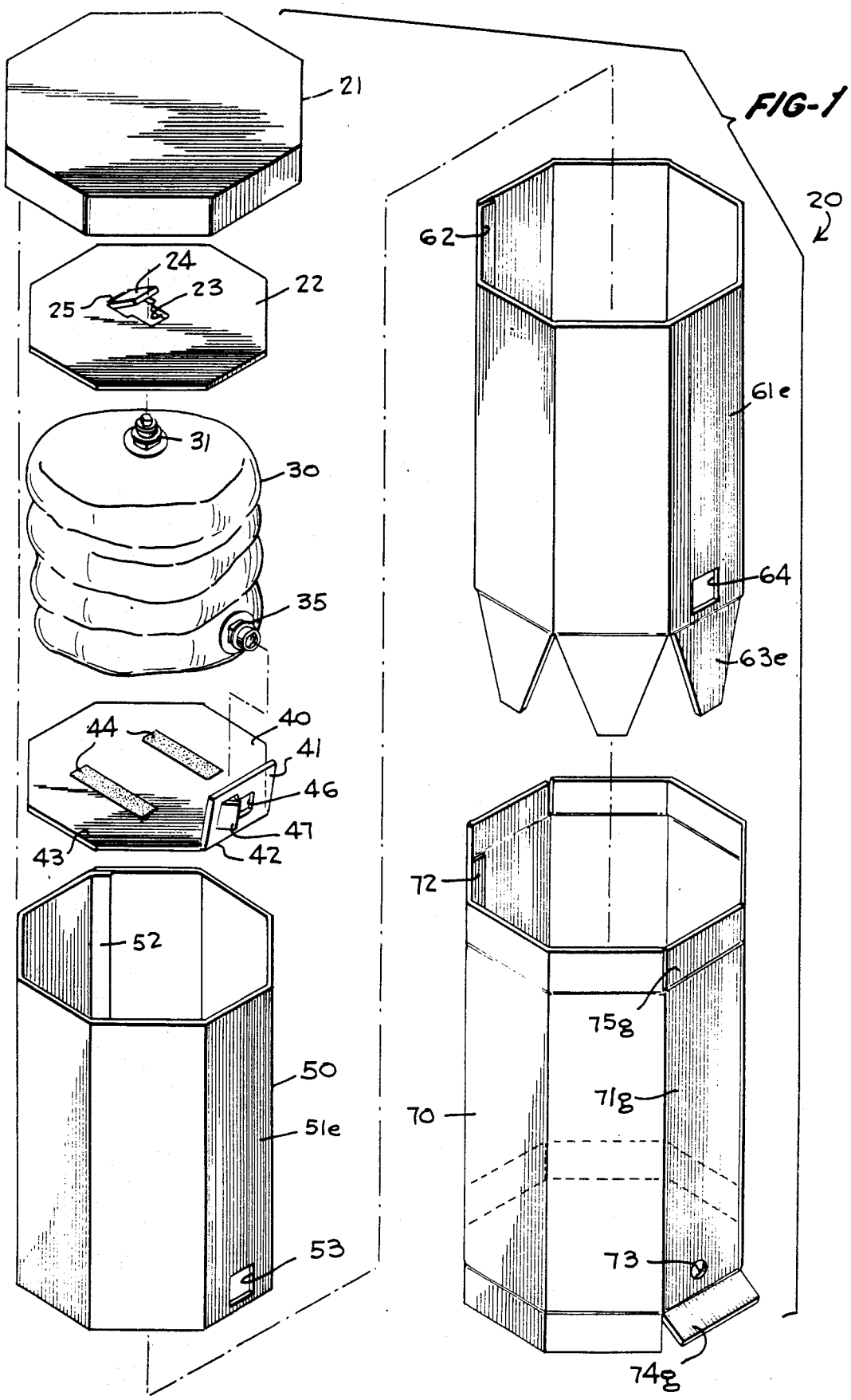
FIG. 1 is an exploded view of a container for fluent material in accordance with the present invention.

Referring now to the drawings where like and corresponding reference numerals are used for like or corresponding parts throughout the several views, there is shown in FIG. 1 an exploded perspective view of the parts of the container 20 in accordance with the present invention. These parts include an octagonal skirted closure cap 21 of conventional construction, a top plate 22, a bag 30 of liquid-impervious material and of octagonal shape, a bottom plate 40, an inner liner 50, a liner 60, and a shell 70.

The top plate 22, the bottom 40, liners 50 and 60, and shell 70 are all made of multi-wall corrugated paperboard, such as double-wall board or triple-wall board. Such double-wall and triple-wall board used for containers is relatively strong to sustain heavy load forces, and is so stiff that it cannot be flexed with human strength. The top plate 22 is of polygonal, preferably, octagonal shape as shown and has a rectangular opening 23 in the center thereof. Adjacent opening 23 is a tab 24 which is partially severed from top plate 22 along three of its edges, being hingedly connected to top plate 22 at a foldline 25.

The bag 30 is of liquid-impervious material of substantial strength and is octagonal in plan form. At its top, it has an inlet fitting 31 which is fluid-conducting and is used for filling the container. On a wall near the bottom, there is a discharge fitting 35.

The bottom plate 40 is octagonal and of somewhat smaller dimensions than the top plate 22. A flap 41 extends from bottom plate 40, being connected thereto by a foldline 42 which extends transversely of the line of the corrugations indicated by the dashed lines 43. A pair of double-faced adhesive strips 44 are on the top surface of the bottom plate 40 and engage also the bottom of the bag 30. The flap 41 has an opening 46 and tab 47 which are of the same construction as the opening 23 and tab 24 of top plate 22.

Figure 4:
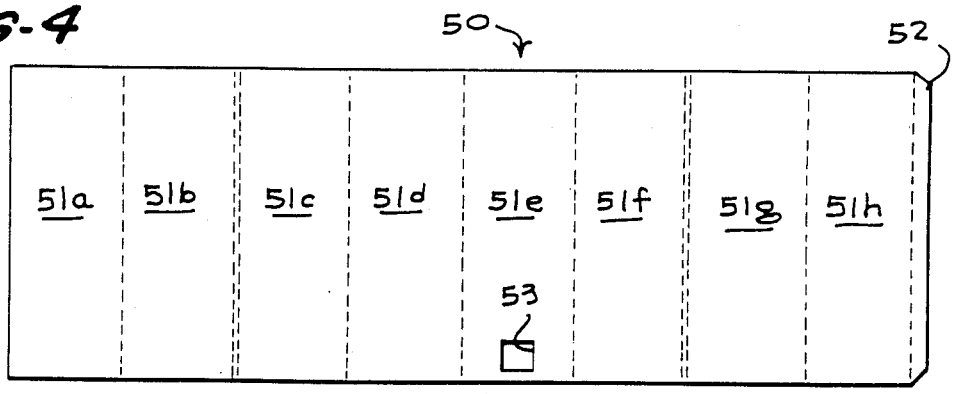
FIG. 4 is plan view of a blank for forming another layer of the liner of the container.

Inner liner 50 is formed as a tube from the blank shown in FIG. 4 in which there are eight panels 51*a*–51*h* which are separated by foldlines indicated by the dashed lines on FIG. 4. Double fold lines are between panels 51*b* and 51*c*, and between panels 51*f* and 51*g*, to permit the thick liner 50 to be folded flat, when laminated to liner 60. A conventional flap 52 is provided which is secured by adhesive to the panel 51*a* to form a conventional manufacturer's joint, so that the blank as shown in FIG. 4 provides the tubular liner construction shown in FIG. 1. An opening 53 as shown in FIGS. 1 and 4 is located in panel 51*e*.

Figure 3:
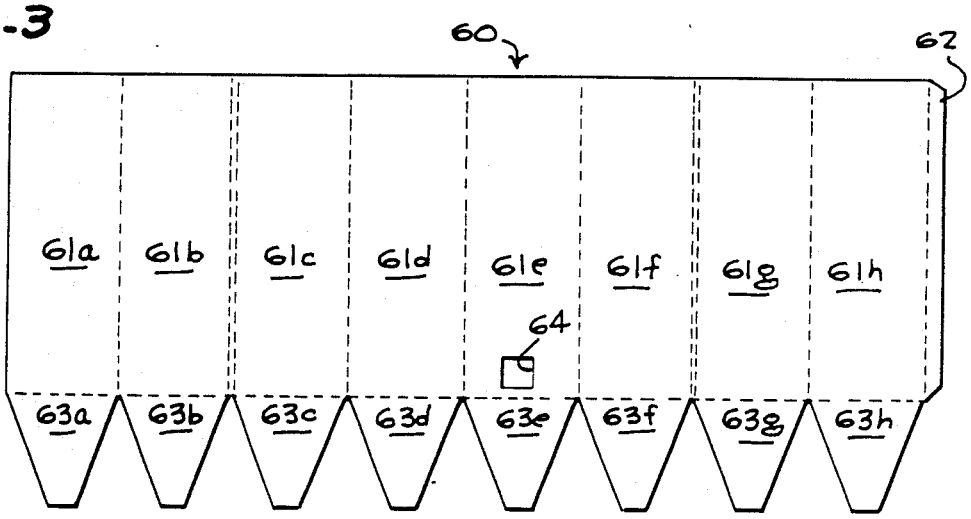
FIG. 3. is a plan view of a blank for forming one layer of a liner for the container.

The liner 60 is, like liner 50, formed from a blank of triple-wall board and comprises eight panels 61*a*–61*h* in serial relationship, shown in FIG. 3. A flap 62 is provided on the panel 61*h* and pyramidal bottom-forming flaps 63*a*–63*h* are separated by foldlines from panels 61*a*–61*h*, respectively. An opening 64 is provided at the bottom of the panel 61*e*. Double fold lines are provided corresponding to the double fold lines in liner 50.

Figure 2:
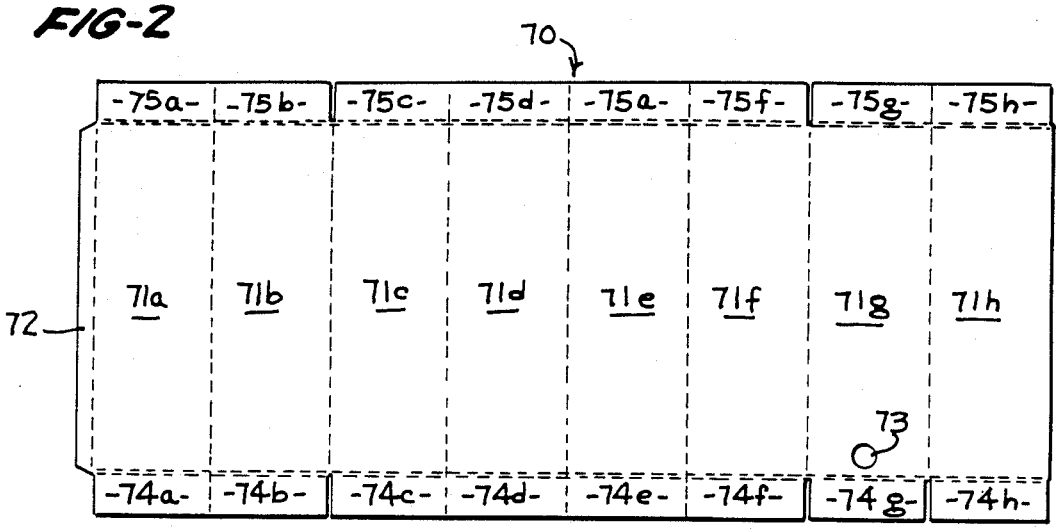
FIG. 2. is a plan view of a blank for forming the shell of the container.

Shell 70 is formed of the blank shown in FIG. 2 and comprises eight serially connected panels 71*a*–71*h*. There is provided on the blank a flap 72, and there is an opening 73 near the bottom of panel 71*g*. In addition, there are flaps 74*a*–74*h* at the bottom of each of the panels 71*a*–71*h*, respectively, and flaps 75*a*–75*h* at the top of each of the panels 71*a*–71*h*, respectively. A slot separates flaps 74*b* and 74*c*, and slots are on either side of flap 74*g*. There are slots between flaps 75*b* and 75*c*, and flaps 75*f* and 75*g*. Preferably, due to the thickness of the material of which the liner 70 is made, the foldlines between the flaps 74 and 75 and the panel 71 are double foldlines.

After the liners 50 and 60 and shell 70 are fabricated, the liners 50 and 60 are laminated to each other, so as to form a tube which is octagonal. It is then flattened for shipment, in known manner, as permitted by the double score lines shown in FIGS. 3 and 4. Further, after the blank of FIG. 2 has the flap 72 thereof glued to the panel 71*h* so as to form a tube, and is flattened, the top flaps 75*a*–75*h* are folded downwardly as illustrated by flaps 75*c*75*f* in FIG. 5 so as to form a cuff at the top of the tube. Similarly, the flaps 74*a*–74*h* at the bottom are folded upwardly so as to form a cuff at the bottom of the flattened shell 70. This construction is shown in FIG. 5 in which the flattened tube forming the shell 70 is encircled with tension bands 76–80, which have been applied by the box manufacturer.

Figure 5:
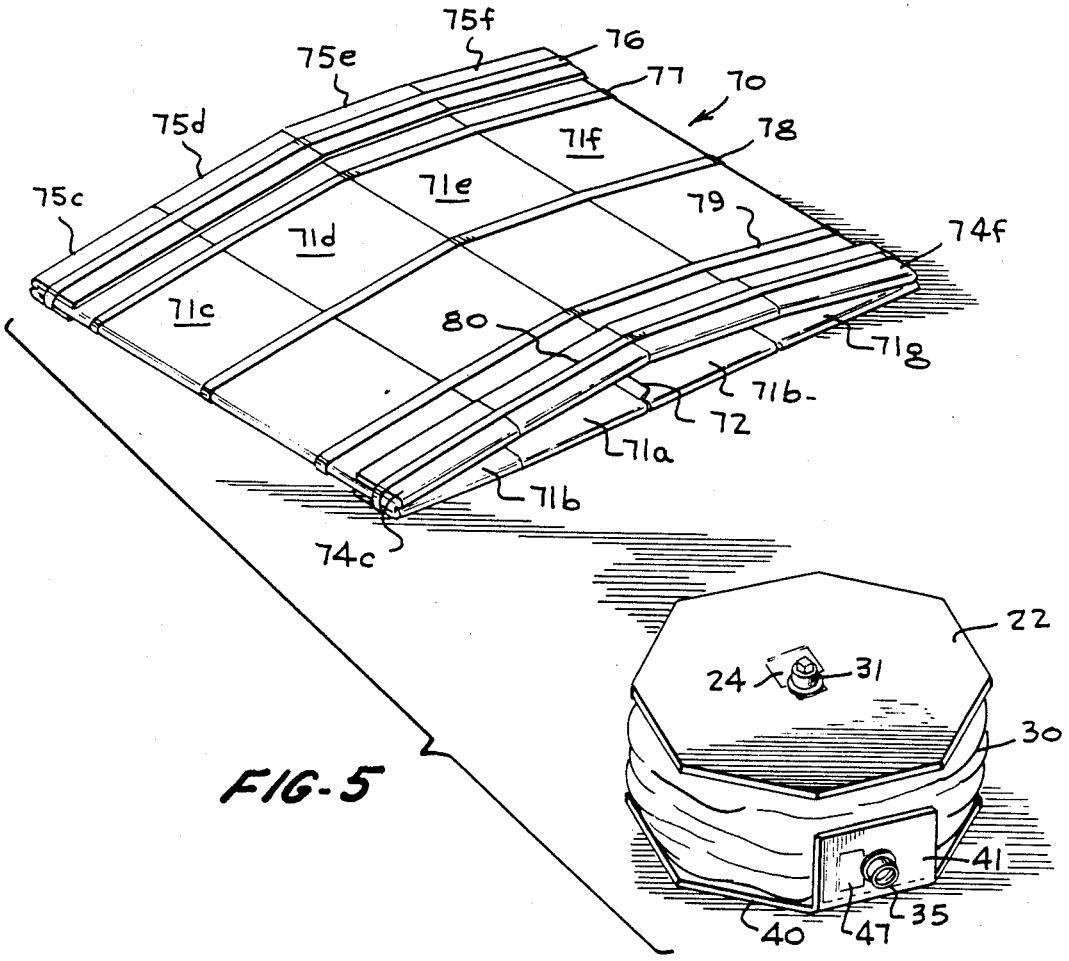
FIG. 5 is a perspective view of parts of the container prepared for shipment in knocked-down form.

Also shown in FIG. 5 is the top plate 22, the bag 30, and the bottom plate 40, all assembled as a unit with the fittings 31 and 35 extending through the top plate 22 and the flap 41, respectively, and held therein by the construction including the tabs 24 and 47, respectively. As will be understood, the flattened shell 70 with tension bands 76–80 forms one component of a kit for a knocked down container. Another part of the kit forming the knocked-down container is the assembled top plate 22, bag 30, and bottom plate 40. Other parts of the kit for the knocked-down container include cap 21 and the liner comprising the laminated liners 50 and 60.

In FIG. 6, there is illustrated the erection of a container, from a kit of knocked-down parts as above described. Preferably, a pallet P is provided, and the shell 70 with the tension bands 76–80 in place is erected into tubular format from the flattened condition. The laminated liner comprising the individual liners 50 and 60 is formed into tubular formation from the flattened condition, and the flaps 63*a*–63*h* are bent inwardly prior to the time of insertion of the laminated liner construction 50, 60 into the shell 70. When the liners 50 and 60 are laminated, the panel 51*d*, will be adjacent the panel 61*d*, so that the opening 64 is in alignment with the slot 53. When the laminated liner 50, 60 is inserted into the shell 70, the panels 51*d* and 61*d* will be in alignment with the panels 71*d*; color coding or other suitable indicia may be provided to ensure correct assemblage. As is apparent from FIG. 6, the height of the shell 70 is greater than the height of the liner 50, 60 so that the upper edges 55 and 65 of the liners 50 and 60, respectively, form a ledge somewhat below the upper edge of the shell 70.

After formation of the container as illustrated in FIG. 6 of the shell 70 and liners 50 and 60, the assemblage including top plate 22, bag 30 and bottom plate 40 is placed over the upper end of the erected container. The flap 41 is rotated so that its upper edge is in overlying relationship to the bottom plate 40, and the bottom plate 40 is then introduced into the container, passing downwardly within the inner liner 50. As will be understood, the flap 41 will be in alignment with the panels 51*e*, 61*e* and 71*g*, and the outer end of fitting 35 will slide along the inner surface of panel 51*d* of inner liner 50 when the bottom plate 40 is relased to drop into the container. Due to the fact that the corrugations of bottom plate 40 and flap 41 extend transversely of the fold line 42, there will be a resilient urging of the flap 41 towards the vertical position, with res)stance of such movement occurring when the bottom plate is descending within the liner 50, 60. This resistance will continue until the fitting 35 reaches the opening 53 and opening 64. The top plate 22, being larger in extent than the bottom plate 40, will lodge n and engage the ledge provided by the upper edges 55 and 65 of liners 50 and 60. Thus, the erection and assemblage of the container 20 will have been accomplished in facile manner without requiring either great skill or tools. The bag 30 is then filled through the filling fitting 31 and the cap 20 is put in place and secured as necessary and the filled container on the pallet is then handled and shipped to its destination.

FIG. 7 shows the container 20 in filled condition on the pallet P and being readied for discharge of the liquid from the the bag 30. This is accomplished by the severing of the strap 80, after which the flap 74*d* is turned down to expose opening 73 and the fitting 35. A combined valve and cutter 90 of known construction (sold under the trademark Drum Major) is provided having a first tube 91 with threads 92 at the end and a cutter 93. A transverse tube 94 is provided having a valve-operating cap 95 for operating a valve therewithin. The threads 92 are caused to engage internal threads of the fitting 35 (see FIG. 9) and, upon sufficient threading engagement, the cutter 93 cuts away a part of the bag 30 which lies interiorly of the fitting 35.

FIG. 8 shows the container assembled, and there may be seen the pallet P, the shell 70 inwardly of which is the laminated liner construct 50, 60.The flaps 63*a* and 63*e* may be seen resting on pallet P with the bottom plate 40 thereon, and the bottom edges of the panels of liner 50 adjoin the top surface of the trapezoidal flaps, including flaps 63*a* and 63*e*. The top plate 22 is shown resting on the ledge formed by the upper edges 55 and 65, with the filling fitting 31 in the top plate 22. The flap 75*d* on shell 70 is shown in position on the outer surface of the panel 75*d* and secured in position by the tension band 76. The tension band 80 has been severed and flap 74*d* turned downwardly so as to expose the fluid-conducting discharge fitting 35 through the opening 73.

FIG. 9 shows the flap 74*d* in place held by tension band 80 which is the position of flap 74*d* after bag 30 has been filled with liquid as shown. Thus, the flap 74*d* protects the fitting 35 and ensures against accidental puncturing of bag 30 or damage to the fitting 35 during shipment and storage. Fitting 35 will be seen extending into the slot 53 and opening 64 in liners 50 and 60, respectively, and the flap 41 will be seen to be in facing engagement relationship with the interior surface of liner 50, being urged there by the resiliency of the material urging it in a clockwise direction as shown in FIG. 9 about the foldline 42. Fitting 35 will be seen to have internal threads 36 for engagement by the threads 92 of the valve and cutter 90. Fitting 35 will also be seen to have a pair of axially spaced flanges 37 and 38 on either side of the flap 41 and tab 47. In conventional manner, the fitting 35 will have been secured to the surface of bag 30, and bag 30 inwardly of the fitting 35 will be imperforate.

FIG. 10 and FIG. 11 show the construction in which the fluid-conducting inlet fitting 31 is assembled to top plate 22. Tab 24 which is adjacent to opening 23 will have been rotated about the foldline 25 so as to be approximately perpendicular to top plate 22. The fitting 31 will have been aligned with the opening provided by this positioning of the tab 24 and moved transversely of the plane of top plate 22, so that the outermost flange 32 is beyond the upper surface of top plate 22. The fitting 31 has been moved laterally into the opening 23, with the flange 32 as shown in FIG. 11 overlying the upper surface of top plate 22. The flange 33 underlies the bottom surface of top plate 22, and in this way, there is resistance to axial movement of fitting 31 in either direction. The tab 24 is then rotated about the foldline 25 so as to lie in the plane of top plate 22, as shown in FIG. 11, entering into the space between the flanges 32 and 33 and blocking movement of fitting 31 transversely of its axis, other than to a small extent as permitted by the clearance shown in FIG. 11, which allows return movement (to the left) to enable flanges 32 and 33 to receive a portion of tab 24 between them. By this construction, the fitting 31 may be readily assembled without tools with the top plate 22. As shown in FIG. 11, an opening 36 is provided in the bag 30 inwardly of the fitting 31, so that bag 30 may be filled through fitting 31. As above noted, the interengagement of discharge fitting 35 with flap 41 is the same as the interengagement of the filling fitting 31 with the top plate 22. The fittings are of the same constructions with the outstanding flanges described, and both of the corrugated board elements are provided with the same opening and tab construction.

There has been provided a shipping container for fluent material, including a bag, the shipping container being of strong construction and capable of being shipped as a kit from which the container may be erected without requiring highly skilled personnel or tools. Part of the container in kit form may be preassembled as a convenience, including the assemblage of the bag to top and bottom plates and the assemblage of a shell and tension bands as preassembled subcomponents of the kit. The container includes fluid-conducting fittings which are secured to the bag and which fittings are completely protected and concealed during shipment, so as to prevent damage either to the fittings or to the bag or material within the bag.

It will be obvious to one skilled in the art that various changes may be made without departure from the spirit of the invention, and therefore the invention is not limited to that shown in the drawings and described in the specification, but only as indicated in the appended claims.

We claim:

1. A container for large quantities of fluent material comprising:

a plurality of serially connected panels having bottom edges, each of said panels being in angular relationship to an adjacent panel to thereby form an encompassing wall, the panels of said wall each comprising a plurality of layers of multi-wall corrugated board including an outer layer and a layer inwardly of said outer layer, the panels of said last mentioned layer each having a flap extending from the bottom edge thereof, each of said flaps being of generally trapezoidal shape and extending from and connected to the lower edge of a said panel at a fold line, said trapezoidal flaps extending inwardly of said wall and forming the bottom of said container.

2. The container of claim 1, wherein the panels of said wall each comprise three layers of multi-wall corrugated board, said flaps extending from the intermediate of said three layers, and said inner layer comprising panels having bottom edges which adjoin the upper surfaces of said trapezoidal flaps.

3. The container of claim 2 wherein the inner two layers are of triple-wall corrugated board.

4. The container of claim 1, said container comprising three layers of multi-wall corrugated board, the lower edges of the panels of said outer layer having a flap foldably connected thereto, said flaps each being adjacent the outer surface of the panel to which it is foldably connected.

5. A structure for producing a container comprising:

a blank comprising a plurality of panels in serial array connected together at adjacent foldlines, said structure including end panels, means joining the end panels together to form a continuous wall structure, said wall structure being in flat condition with each panel being in facing, substantially engaging relationship with another panel of said blank, and at least one band encircling said flattened continuous wall structure. said band being of material strong in tension and tightly encircling said flattened continuous wall structure.

6. The structure of claim 5, wherein each of said panels is of multiple layers of corrugated paperboard.

7. A container for holding large quantities of fluent material comprising:

at least two contiguous layers of multi-wall corrugated paperboard, each comprising panels in angular relation to adjacent panels and foldably connected thereto at fold lines between said panels, means for adhering together said two layers, the outermost of said two layers having flaps extending from the bottom edge thereof, each of said flaps being of generally trapezoidal shape and extending from and connected to the lower edge of a said panel at a fold line at the bottom thereof, said flaps extending inwardly and forming the bottom of said container, and a shell of multi-wall corrugated paperboard comprising panels in angular relation to adjacent panels and foldably connected thereto at fold lines, said panels of said shell being outwardly of and respectively contiguous with panels of the said outermost of said two first mentioned layers.

8. The container of claim 10, and further comprising aligned openings in said two layers and said shell adjacent the bottoms thereof.

9. The container of claim 8, and a flap at and foldably connected to the bottom of each panel of said shell, each said last mentioned flap being adjacent the outer surface of the panel to which it is foldably connected.

10. The container of claim 7, and a flap at and foldably connected to the bottom of each panel of said shell, each said last mentioned flap being adjacent the outer surface of the panel to which it is foldably connected.

* * * * *